US005957336A

United States Patent [19]

Radassao et al.

[11] Patent Number: 5,957,336

[45] Date of Patent: Sep. 28, 1999

[54] INVERTED DISPENSER

[76] Inventors: Dan Radassao; Antoinette Radassao, both of 13 Gumwood Place, Stoney Creek, Ontario, Canada, L8J 2K7

[21] Appl. No.: 09/022,372

[22] Filed: Feb. 12, 1998

[51] Int. Cl.[6] ..... B67D 5/56; B67D 5/06; B67D 3/00; B65D 35/22

[52] U.S. Cl. ..... 222/129; 222/94; 222/185.1; 222/546; 222/487

[58] Field of Search ..... 222/129, 94, 173, 222/185.1, 546, 556, 212, 142.1, 142.2, 142.4, 482, 487, 564

[56] References Cited

U.S. PATENT DOCUMENTS

| | | | |
|---|---|---|---|
| 2,652,951 | 9/1953 | Esposito et al. | 222/142.1 |
| 2,717,727 | 9/1955 | Robb | 222/212 |
| 4,754,898 | 7/1988 | Britt et al. | 222/487 |
| 4,856,685 | 8/1989 | Gaffney | 222/564 |
| 5,147,072 | 9/1992 | Dirksing | 222/212 |
| 5,252,312 | 10/1993 | Gentile et al. | 222/94 |
| 5,653,361 | 8/1997 | Favre | 222/212 |
| 5,765,725 | 6/1998 | Matt | 222/129 |

*Primary Examiner*—Andres Kashnikow
*Assistant Examiner*—Keats Quinalty

[57] ABSTRACT

A viscous fluid dispenser is provided including an upper extent constructed from a flexible material and having a top face and a peripheral side wall with an inverted frusto-conical configuration defining a lower peripheral edge. Further provided is a lower extent constructed from a rigid material and having a planar bottom face coupled with respect to the lower peripheral edge of the upper extent. The bottom face of the lower extent has at least one bore formed therein. Next provided is a lid hingably coupled to the lower extent for selectively closing the bore.

13 Claims, 2 Drawing Sheets

INVERTED DISPENSER

BACKGROUND OF THE INVENTION

1. Field of the Invention

The present invention relates to dispensers and more particularly pertains to a new inverted dispenser for dispensing a variety of viscous condiments.

2. Description of the Prior Art

The use of dispensers is known in the prior art. More specifically, dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art dispensers include U.S. Pat. No. 4,488,667; U.S. Pat. No. 4,193,521; U.S. Pat. No. 5,141,136; U.S. Pat. No. 5,353,965; and U.S. Pat. Des. 362,595.

In these respects, the inverted dispenser according to the present invention substantially departs from the conventional concepts and designs of the prior art, and in so doing provides an apparatus primarily developed for the purpose of dispensing a variety of viscous condiments.

SUMMARY OF THE INVENTION

In view of the foregoing disadvantages inherent in the known types of dispensers now present in the prior art, the present invention provides a new inverted dispenser construction wherein the same can be utilized for dispensing a variety of viscous condiments.

The general purpose of the present invention, which will be described subsequently in greater detail, is to provide a new inverted dispenser apparatus and method which has many of the advantages of the dispensers mentioned heretofore and many novel features that result in a new inverted dispenser which is not anticipated, rendered obvious, suggested, or even implied by any of the prior art dispensers, either alone or in any combination thereof.

To attain this, the present invention generally comprises an upper extent constructed from a flexible material. As shown in FIG. 1, the upper extent has a planar circular top face and a peripheral side wall with an inverted frusto-conical configuration defining a lower peripheral edge. The peripheral side wall as a plurality of parallel, angled indentations formed therein for gripping purposes. Next provided is a lower extent constructed from a rigid material. The lower extent is formed of a circular bottom face with a peripheral side wall having an inverted frusto-conical configuration defining an upper peripheral edge. Such upper peripheral edge is integrally coupled to the lower peripheral edge of the upper extent. The bottom face has a first side with a first circular bore formed therein with a first diameter. A second side of the bottom face is equipped with a second circular bore formed therein with a second diameter greater than the first diameter. As shown in FIG. 4, the first side and second side are divided by a diametrically disposed bisecting line. The lower extent further includes a pair of angled surfaces formed on a periphery of the bottom face of the lower extent at ends of the bisecting line. Each angled surface has a semicircular configuration. Finally, a lid assembly is provided including a pair of planar semicircular lids each having a first edge hingably coupled to an edge of a common one of the angled surfaces. A top face of each lid is equipped with a circular protrusion formed therein. By this structure, each lid is adapted to pivot between an open configuration and a closed orientation with the protrusion thereof being snappily coupled within the circular bore of the associated side of the bottom face of the lower extent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inverted dispenser apparatus and method which has many of the advantages of the dispensers mentioned heretofore and many novel features that result in a new inverted dispenser which is not anticipated, rendered obvious, suggested, or even implied by any of the prior art dispensers, either alone or in any combination thereof.

It is another object of the present invention to provide a new inverted dispenser which may be easily and efficiently manufactured and marketed.

It is a further object of the present invention to provide a new inverted dispenser which is of a durable and reliable construction.

An even further object of the present invention is to provide a new inverted dispenser which is susceptible of a low cost of manufacture with regard to both materials and labor, and which accordingly is then susceptible of low prices of sale to the consuming public, thereby making such inverted dispenser economically available to the buying public.

Still yet another object of the present invention is to provide a new inverted dispenser which provides in the apparatuses and methods of the prior art some of the advantages thereof, while simultaneously overcoming some of the disadvantages normally associated therewith.

Still another object of the present invention is to provide a new inverted dispenser for dispensing a variety of viscous condiments.

Even still another object of the present invention is to provide a new inverted dispenser that includes an upper extent constructed from a flexible material and having a top face and a peripheral side wall with an inverted frusto-conical configuration defining a lower peripheral edge. Further provided is a lower extent constructed from a rigid material and having a planar bottom face coupled with respect to the lower peripheral edge of the upper extent. The bottom face of the lower extent has at least one bore formed therein. Next provided is a lid hingably coupled to the lower extent for selectively closing the bore.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
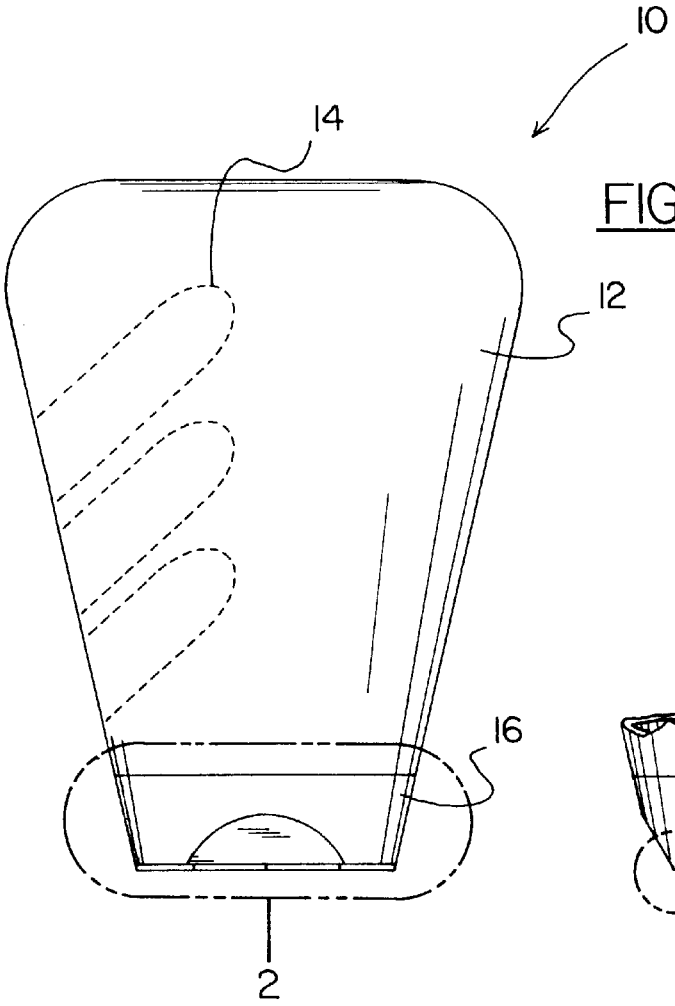
FIG. 1 is a side view of a new inverted dispenser according to the present invention.
Figure 2:
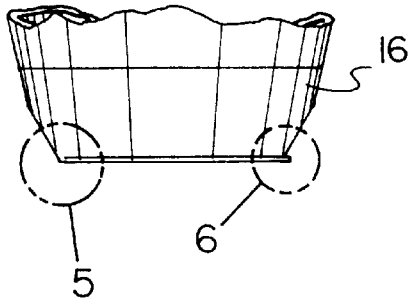
FIG. 2 is a side view of only the lower extent of the present invention taken from circle 2 of FIG. 1.
Figure 3:
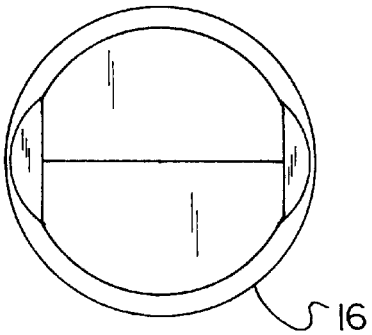
FIG. 3 is a bottom view of the present invention.

With reference now to the drawings, and in particular to FIGS. 1 through 8 thereof, a new inverted dispenser embodying the principles and concepts of the present invention and generally designated by the reference numeral 10 will be described.

The present invention, designated as numeral 10, includes an upper extent 12 constructed from a flexible material. As shown in FIG. 1, the upper extent has a planar circular top face and a peripheral side wall with an inverted frusto-conical configuration defining a lower peripheral edge.

The peripheral side wall has a plurality of parallel, angled indentations 14 formed therein for gripping purposes. Ideally, the aforementioned angle is about 45 degrees. In the preferred embodiment, at least three indentations are provided each of which have a unique length and take the shape of a finger. As shown in FIG. 1, a length of the indentations adjacent to the lower peripheral edge is less than that of the indentations adjacent to the top face.

Next provided is a lower extent 16 constructed from a rigid material. The lower extent is formed of a circular bottom face with a peripheral side wall having an inverted frusto-conical configuration defining an upper peripheral edge. Such upper peripheral edge is integrally coupled to the lower peripheral edge of the upper extent. as shown in FIG. 1, a height of the lower extent is less than ⅙ a height of the upper extent. Further, the side walls of the upper and lower extents afford a continuous smooth transitioning surface.

Figure 4:
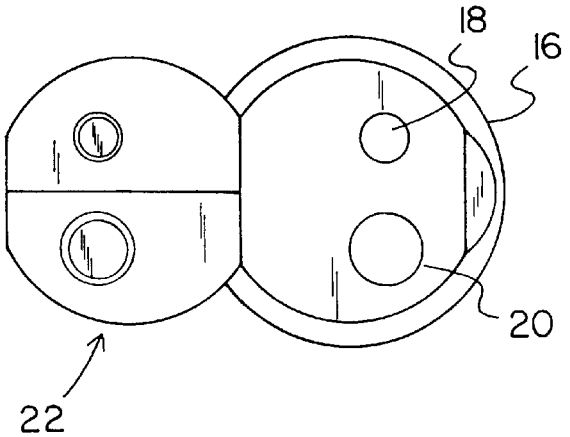
FIG. 4 is a bottom view of the present invention with the lids in an open orientation.
Figure 5:
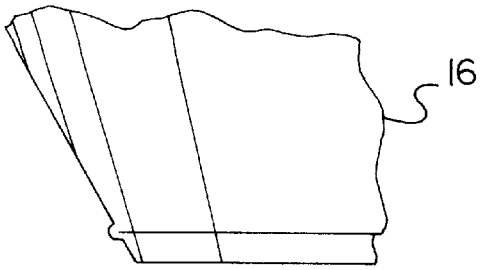
FIG. 5 is a side view of the lower extent of the present invention taken from circle 5 of FIG. 2 showing the hingable coupling of one of the lids.
Figure 6:
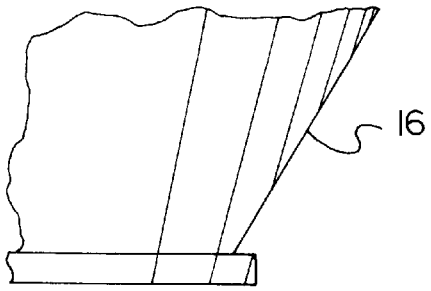
FIG. 6 is a side view of the lower extent of the present invention taken from circle 6 of FIG. 2 showing an opening end of one of the lids.

The bottom face of the lower extent has a first side with a first circular bore 18 formed therein with a first diameter. A second side of the bottom face is equipped with a second circular bore 20 formed therein with a second diameter about twice the first diameter. As shown in FIG. 4, the first side and second side are divided by a diametrically disposed bisecting line. The lower extent further includes a pair of equally sized angled surfaces formed on a periphery of the bottom face of the lower extent at ends of the bisecting line. Each angled surface further has a semicircular configuration. It should be noted that the bores are each formed adjacent to a common one of the angled surfaces and an equal distance therefrom.

Finally, a lid assembly 22 is provided including a pair of planar semicircular lids each having a first edge hingably coupled to an edge of a common one of the angled surfaces. A top face of each lid is equipped with a circular protrusion formed therein. By this structure, each lid is adapted to pivot between an open configuration and a closed orientation with the protrusion thereof being snappily coupled within the circular bore of the associated side of the bottom face of the lower extent. When closed, the lids preferably extend beyond and are spaced from one of the angled surfaces for being easily gripped. Further, it should be noted that the lids together form a circle with an area equal to that of the bottom face of the lower extent.

Figure 7:
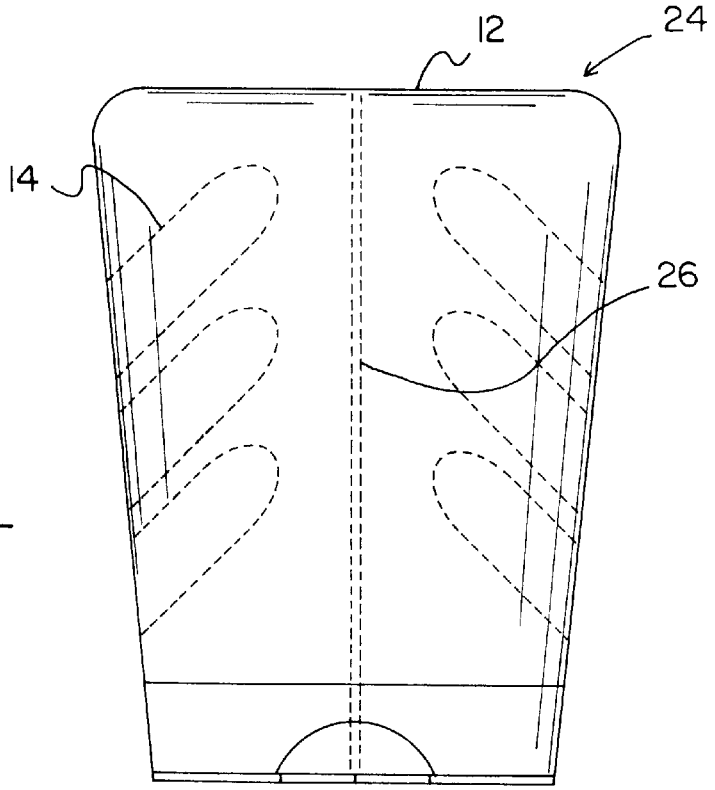
FIG. 7 is a side view of an alternate embodiment of the present invention.
Figure 8:
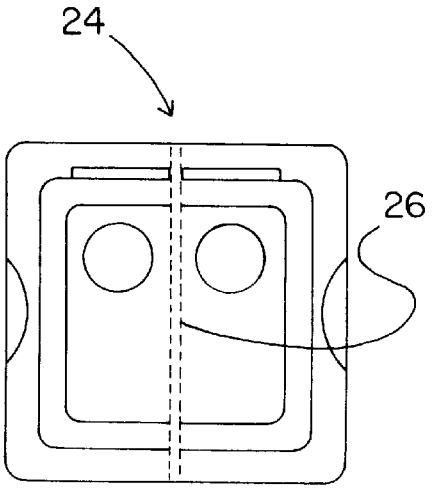
FIG. 8 is a bottom view of the alternate embodiment of the present invention.

In an alternate embodiment 24, as shown in FIGS. 7 & 8, the periphery of the upper and lower extents are provided with less of a taper. Further, the bottom face of the lower extent has a rectangular cross-section. An important feature of the present embodiment is a bisecting divider 26 formed within the upper and lower extents. As shown in FIG. 8, the circular bores of the present embodiment each have a common diameter. Further, two sets of gripping indentations are included each for an associated compartment defined by the bisecting divider.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A viscous fluid dispenser comprising, in combination:

an upper extent constructed from a flexible material and having a planar circular top face and a peripheral side wall with an inverted frusto-conical configuration defining a lower peripheral edge, the peripheral side wall having a plurality of parallel, angled indentations formed therein for gripping purposes;

each of the indentations having an elongate shape for receiving a finger for helping prevent slipping of the finger from the indentation:

wherein the peripheral sidewall has two sets of at least three elongate indentations such that at least one of the sets is positioned towards a user's fingers when the upper extent is held and rotated in a hand of a user;

the upper extent having a longitudinal axis extending between the top face and an opposite end thereof, wherein the elongate indentations each have a longitudinal axis oriented at an angle of about 45 degrees from the longitudinal axis of the upper extent for conforming to fingers of a user for helping hold the fingers in a central position on the peripheral sidewall;

each of the elongate indentations having a unique length, wherein a length of the indentations adjacent to the lower peripheral edge is less than that of the indentations adjacent to the top face;

a lower extent constructed from a rigid material and having a circular bottom face with a peripheral side wall with an inverted frusto-conical configuration defining an upper peripheral edge being integrally coupled to the lower peripheral edge of the upper extent, the bottom face having a first side with a first circular bore formed therein with a first diameter and a second side with a second circular bore formed therein with a second diameter greater than the first diameter, wherein the first side and second side are divided by a diametrically disposed bisecting line, the lower extent further including a pair of angled surfaces formed on a periphery of the bottom face of the lower extent at ends of the bisecting line with each angled surface having a semicircular configuration;

wherein the peripheral sidewalls of the upper and lower extents afford a continuous smooth transitioning surface for helping permit easier cleaning of outer surfaces of the upper and lower extents;

wherein the upper and lower extent have a central divider for defining a pair of separate compartments; and a lid assembly including a pair of planar semicircular lids each having a first edge hingably coupled to an edge of a common one of the angled surfaces and a top face with a circular protrusion formed therein, whereby each lid is adapted to pivot between an open configuration and a closed orientation with the protrusion thereof being snappily coupled within the circular bore of the associated side of the bottom face of the lower extent.

2. A viscous fluid dispenser comprising:

an upper extent constructed from a flexible material and having a top face and a peripheral side wall with an inverted frusto-conical configuration defining a lower peripheral edge. the peripheral side wall having a plurality of parallel, angled elongate indentations formed therein for gripping purposes;

a lower extent constructed from a rigid material and having a planar bottom face coupled with respect to the lower peripheral edge of the upper extent, the bottom face having at least one bore formed therein;

the upper extent having a longitudinal axis extending between the top face and an opposite end thereof, wherein longitudinal axes of the elongate indentations are oriented at an angle of about 45 degrees from the longitudinal axis of the upper extent for conforming to fingers of a user for helping hold the fingers in a central position on the peripheral sidewall; and a lid hingably coupled to the lower extent for selectively closing the bore.

3. A viscous fluid dispenser as set forth in claim 2 wherein a pair of bores are formed in the lower extent each with a separate lid.

4. A viscous fluid dispenser as set forth in claim 2 wherein the lid has a planar configuration.

5. A viscous fluid dispenser as set forth in claim 2 wherein the upper extent has a plurality of gripping indentations formed therein for gripping purposes.

6. A viscous fluid dispenser as set forth in claim 2 wherein the peripheral side wall of the upper extent has a plurality of parallel, angled indentations formed therein for gripping purposes.

7. A viscous fluid dispenser as set forth in claim 2 wherein the lower extent has at least one angled surface adjacent to the lid for facilitating the opening thereof.

8. A viscous fluid dispenser as set forth in claim 2 wherein the upper and lower extents have a circular horizontal cross-section along an entire height thereof.

9. A viscous fluid dispenser as set forth in claim 2 wherein the upper and lower extent have a central divider for defining a pair of separate compartments.

10. A viscous fluid dispenser as set forth in claim 2 wherein the peripheral sidewall of the upper extent has two sets of at least three indentations such that at least one of the sets is positioned towards a user's fingers when the upper extent is held and rotated in a hand of a user.

11. A viscous fluid dispenser as set forth in claim 2 wherein each of the indentations has a unique length, wherein a length of the indentations adjacent to the lower peripheral edge is less than that of the indentations adjacent to the top face.

12. A viscous fluid dispenser as set forth in claim 2 wherein each of the indentations has the shape of a finger for receiving a finger for helping prevent slipping of the finger from the indentation.

13. A viscous fluid dispenser as set forth in claim 2 wherein the peripheral sidewalls of the upper and lower extents afford a continuous smooth transitioning surface for helping permit easier cleaning of outer surfaces of the upper and lower extents.

* * * * *